United States Patent [19]

Aoki

[11] Patent Number: 4,539,884

[45] Date of Patent: Sep. 10, 1985

[54] ELECTRONIC MUSICAL INSTRUMENT OF WAVESHAPE MEMORY TYPE WITH EXPRESSION CONTROL

[75] Inventor: Eiichiro Aoki, Hamamatsu, Japan

[73] Assignee: Nippon Gakki Seizo Kabushiki Kaisha, Hamamatsu, Japan

[21] Appl. No.: 529,977

[22] Filed: Sep. 7, 1983

[30] Foreign Application Priority Data

Sep. 16, 1982 [JP] Japan ..... 57-159637

[51] Int. Cl.[3] ..... G10H 1/02

[52] U.S. Cl. ..... 84/1.24; 84/1.19; 84/1.01

[58] Field of Search ..... 84/1.01, 1.19, 1.24, 84/1.26, 1.1

[56] References Cited

U.S. PATENT DOCUMENTS

| | | | |
|---|---|---|---|
| 4,184,403 | 1/1980 | Whitefield | 84/1.19 |
| 4,383,462 | 5/1983 | Nagai et al. | 84/1.01 |
| 4,442,745 | 4/1984 | Gross et al. | 84/1.19 |

*Primary Examiner*—Forester W. Isen

*Attorney, Agent, or Firm*—Spensley Horn Jubas & Lubitz

[57] ABSTRACT

In an electronic musical instrument of waveshape memory type, a waveshape memory stores waveshape data which covers from start to end of a musical tone and which varies litle by little in shape, amplitude and/or cyclic period as the waveshape extends to the succeeding cycles. A start address from which the waveshape memory begins to be read is controlled by expression control such as a key touch response structure or expression pedal, so that the tone color, level and/or pitch of a produced tone is varied according to the expression control.

10 Claims, 7 Drawing Figures

| a | b |
|---|---|

ELECTRONIC MUSICAL INSTRUMENT OF WAVESHAPE MEMORY TYPE WITH EXPRESSION CONTROL

BACKGROUND OF THE INVENTION

The present invention relates to an electronic musical instrument of waveshape memory type with expression control for varying qualities of a produced musical tone, such as tone color, in response to operation of a performance controller such as a key on a keyboard or an expression pedal.

Prior electronic musical instruments have a waveshape memory serving as a sound source to store whole waveshape information of musical tones to be produced, the waveshape information being read out to generate corresponding musical tone signals. The musical instrument of this type is capable of producing musical tones of high quality as it stores and reads out musical tone waveshapes as they are. However, this known instrument meets difficulty in providing a so-called "touch response function" which can change qualities of a musical tone produced, such for example as tone color or timber, in response to the speed or strength of depression (hereinafter referred to as a "key depression touch") of keys of a keyboard. More specifically, the musical tone waveshapes as they are read out of the waveshape memory remain constant at all times. If the tone color of a musical tone were to be varied through the control of a key depression touch, the waveshape information as read out of the waveshape memory would need to be passed through a digital filter or an analog filter after the waveshape signal has been converted into an analog signal, the filter being controllable in response to the key depression touch. Therefore, the overall circuit arrangement required would become complicated.

SUMMARY OF THE INVENTION

With the above prior difficultes in view, it is an object of the present invention to provide an electronic musical instrument having a waveshape memory as a sound source and capable of controlling the tone color of a musical tone in response to a manual performance controller such as a keyboard or an expression pedal and also of controlling in response thereto the level, decay time and pitch variation, for example, of the musical tone as desired.

Another object of the present invention is to provide an electronic musical instrument of waveshape memory type which performs a touch response function without the use of a filter or the like.

According to the present invention, the above objects can be achieved by an electronic musical instrument of waveshape memory type which stores data on musical tone waveshapes extending through a plurality of consecutive cycles and having waveshapes or tone colors, amplitudes and cyclic periods that vary slightly from cycle to cycle, and which changes a start address to read out the waveshape data in response to operation of a performance controller such as a keyboard or an expression pedal.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
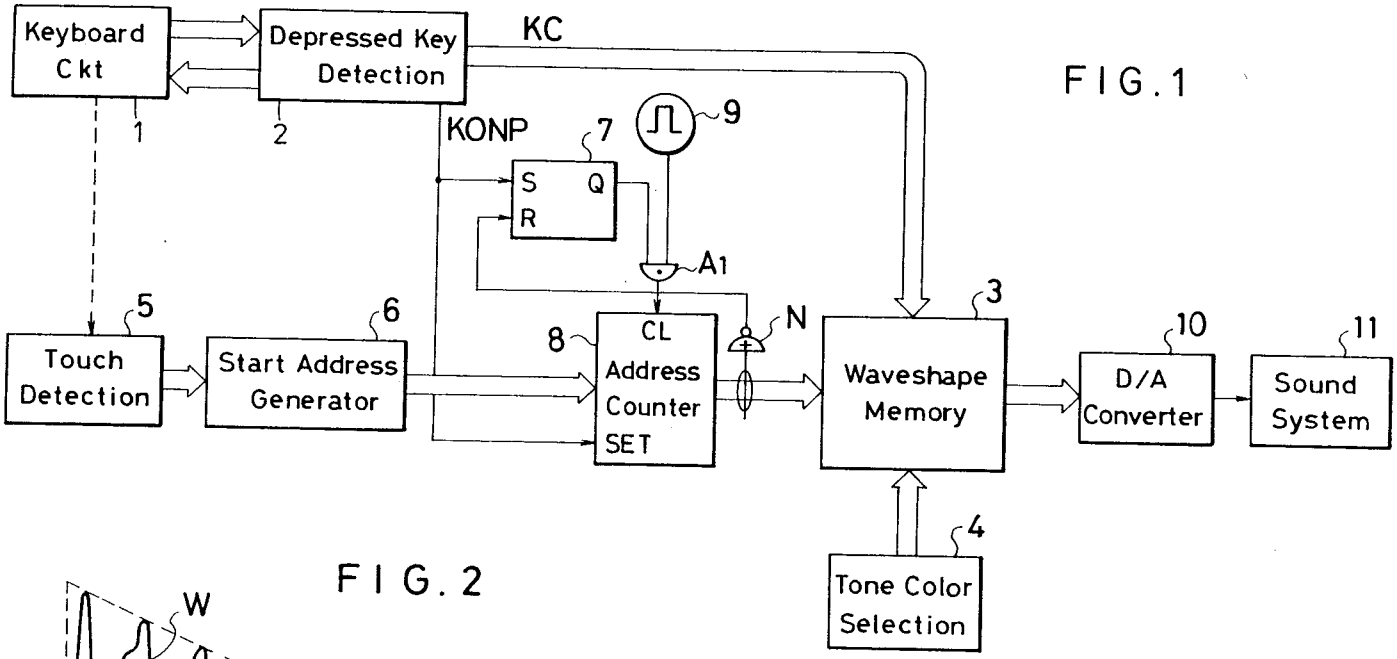
FIG. 1 is a block diagram of an electronic musical instrument according to an embodiment of the present invention.

As shown in FIG. 1, an electronic musical instrument according to an embodiment of the present invention has a keyboard circuit 1 composed of a plurality of key switches corresponding respectively to the keys of a keyboard or keyboards of the electronic musical instrument, such as an upper keyboard, a lower keyboard and a pedal keyboard. The key switches are closed when the corresponding keys are depressed. Depression of each key switch is detected by a depressed-key detection circuit 2, which then produces key information (hereinafter referred to as a "key code KC") representative of a depressed key and a key-on pulse signal KONP representative of a key depression timing. In the illustrated embodiment, the electronic musical instrument is capable of producing monophonic tones. Therefore, when a plurality of keys are depressed at the same time, the depressed-key detection circuit 2 has a priority selection capability for selecting one of the depressed keys which corresponds to a sound of highest (or lowest) pitch and issuing the key code KC and the key-on pulse signal KONP representative of the selected key. The key code KC is in the form of 7-bit data, for example, composed of 3-bit octave codes $B_3$, $B_2$, $B_1$ indicating an octave to which the depressed key belongs, and 4-bit note codes $N_4$, $N_3$, $N_2$, $N_1$ indicating a note of the tone corresponding to the depressed key. The key-on pulse KONP can be produced by differentiating the positive-going edge of a key-on signal which becomes "1" when the key is depressed and falls to "0" when released.

Figure 2:
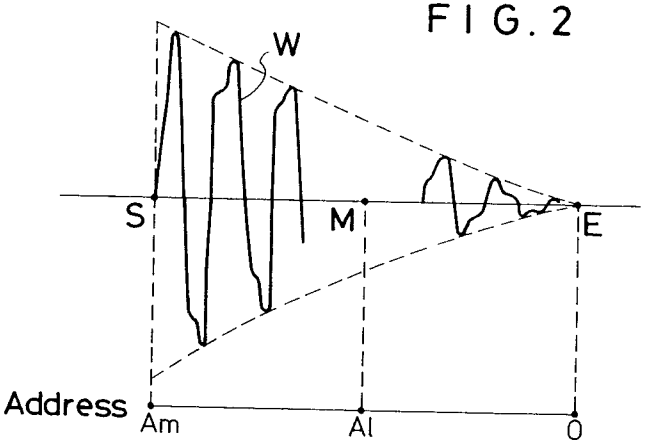
FIG. 2 is a diagram showing the waveform of a musical tone stored in a waveshape memory in the electronic musical instrument shown in FIG. 1.

A waveshape memory 3 comprises a plurality of read-only memories (ROM) provided for respective tone colors such as piano, guitar, marimba, for example, selectable by a tone color selection circuit 4, each ROM storing data on the musical tone waveshape of the corresponding tone color. Each ROM also has a plurality of storage areas corresponding respectively to the keys, the number of the storage areas being equal to that of the keys, and each storage area stores sample data representative of a musical tone waveshape having a pitch for the corresponding key and extending from a beginning to an end of the musical tone through a plurality of cyclic periods at a prescribed pitch frequency, as illustrated in FIG. 2. In response to an output from the tone color selection circuit 4, one of the ROMs in the waveshape memory 3 is selected and one of the storage areas in the designated ROM is selected by the key code KC. The content (musical tone waveshape data) of the selected storage area is successively read out in response to an output from an address counter 8.

The musical tone waveshape data stored in the waveshape memory 3 will now be described in greater detail. The musical tone waveshape data are composed of waveshape data extending through a plurality of cycles and having waveshapes, amplitudes, and cyclic periods all varying slightly from cycle to cycle. It is preferable that the amplitude be progressively decayed from cycle to cycle. The waveshapes may incorporate vibrato and tremolo effects.

A key depression touch upon depression of a key is detected by a touch detection circuit 5, which produces a touch signal indicative of the detected key depression touch. The touch detection circuit 5 may comprise a device such as a piezoelectric element or an electromagnetic coil capable of generating an electromotive force in response to the strength (pressure) of a key depression touch, or a photoelectric device for producing an electric signal in response to a key depression touch. The touch signal produced by the touch detection circuit 5 should preferably be a digital signal. If a key depression touch is detected as an analog signal, it should be converted into a corresponding digital signal. A start address generator 6 serves to generate a signal indicative of a start address from which to start reading out the musical tone waveshape data stored in the waveshape memory 3. The start address signal varies in response to the touch signal issued from the touch detection circuit 5, and gives an address which is the greater the stronger the key depression touch is, according to the illustrated embodiment. For example, as shown in FIG. 2, a readout start address $A_m$ corresponds to a maximum key depression touch, and a readout start address $A_1$ to a minimum key depression touch.

The key-on pulse signal KONP issued from the depressed-key detection circuit 2 is applied to a set terminal S of an RS flip-flop 7 and a preset terminal SET of an address counter 8 which receives the readout start address signal from the start address generator 6. The RS flip-flop 7 produces an output "1" at its Q terminal when the key-on pulse signal KONP is applied to the set terminal S. The output from the RS flip-flop 7 enables an AND gate A1 to pass a readout clock signal of a constant frequency from a clock generator 9 to a clock terminal CL of the address counter 8. The address counter 8 is responsive to the key-on pulse signal KONP for presetting the readout start address signal issued from the start address generator 6, thereby counting down the addresses from the designated readout start signal each time the clock signal is applied. The count in the address counter 8 is fed as a waveshape data readout address signal to the waveshape memory 3. An initial value of the waveshape data readout address signal is determined by the strength of the key depression touch as described above.

Out of the musical tone waveshape data stored in the waveshape memory 3 for the respective tone colors and keys for each tone color, the waveshape memory 3 reads the musical tone waveshape data corresponding to the key designated by the key code KC from the depressed-key detection circuit 2 with the tone color selected by the tone color selection circuit 4, the data being read out successively in response to the address signal from the address counter 8. More specifically, as shown in FIG. 2, the musical tone waveshape data, referred to as W, stored in the waveshape memory 3 is read out as closely to a starting point S thereof as the key depression touch is large, and as closely to an ending point E as the key depression touch is small. For example, with the readout start address $A_m$ corresponding to the maximum key depression touch, the musical tone waveshape data at the starting point S of the musical tone waveshape W is first read out, and then the musical tone waveshape data are successively read out in response to the address signal which becomes progressively reduced. With the readout start address $A_1$ corresponding to the minimum key depression touch, the musical tone waveshape data are read out from an intermediate point M of the musical tone waveshape W. It is preferable here that the start address from which to start reading out the musical tone waveshape data be an address at a zero-crossing point of the musical tone waveshape W. To this end, the stard address generator 6 may comprise a memory for storing addresses at zero-crossing points, and the stored addresses may be read in response to an output from the touch detection circuit 5.

When the count in the address counter 8 falls to "0", that is, all of the bits of the count become "0", a signal "1" is applied through a NOR gate N to a reset terminal R of the RS flip-flop 7 to reset the latter. At this time, the musical tone waveshape data in the waveshape memory 3 is read at the ending point E, and the reading of the musical tone waveshape data is finished as the clock signal is no longer applied to the clock terminal CL of the address counter 8. The musical tone waveshape data as read out of the waveshape memory 3 are delivered to a D/A converter 10 and converted thereby into an analog signal, which is reproduced as a musical sound by a sound system 11. With this arrangement, since the start point from which to read out the musical tone waveshape data varies with the magnitude or strength of the key depression touch, the waveshape, amplitude and cyclic period of any musical tone waveshape as read out changes with the key depression touch. As a consequence, the tone color, level, pitch and decay time of a generated musical tone are varied.

A polyphonic electronic musical instrument according to the present invention will then be described with reference to FIG. 3. The polyphonic electronic musical instrument includes the same keyboard circuit 1, the tone color selection circuit 4, the touch detection circuit 5, the D/A converter 10, and the sound system 11 as those shown in FIG. 1.

Figure 3:
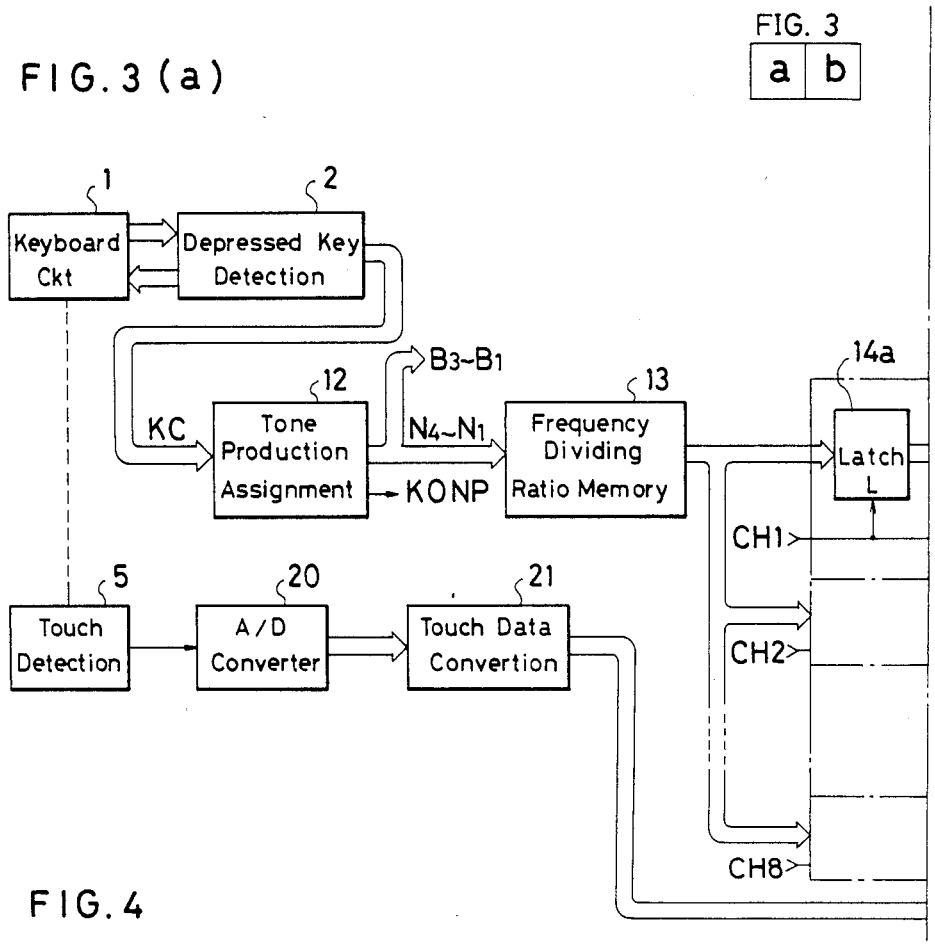
FIGS. 3*a* and 3*b* are a block diagram of an electronic musical instrument according to another embodiment of the present invention.

As illustrated in FIG. 3, a tone production assignment circuit 12 is responsive to a key code KC issued from a depressed-key detection circuit 2 for assigning depressed keys of the keyboard to a plurality (8, for example) of musical tone production channels, respectively, and generating on a time-sharing basis key codes KC indicative of the keys assigned to the channels and key-on pulse signals KONP representative of timings of key depressions in synchronism with channel timings (time slots). A frequency dividing ratio memory 13 is composed of a read-only memory (ROM) which stores frequency dividing ratios corresponding respectively to the pitches ($C_6$#–$C_7$) of twelve notes belonging to a highest octave. The frequency dividing ratio memory 13 serves to produce the frequency dividing ratio data for each time slot on a time-sharing basis in response to note codes $N_4$–$N_1$ of the key codes KC from the musical tone production assignment circuit 12.

Figure 4:
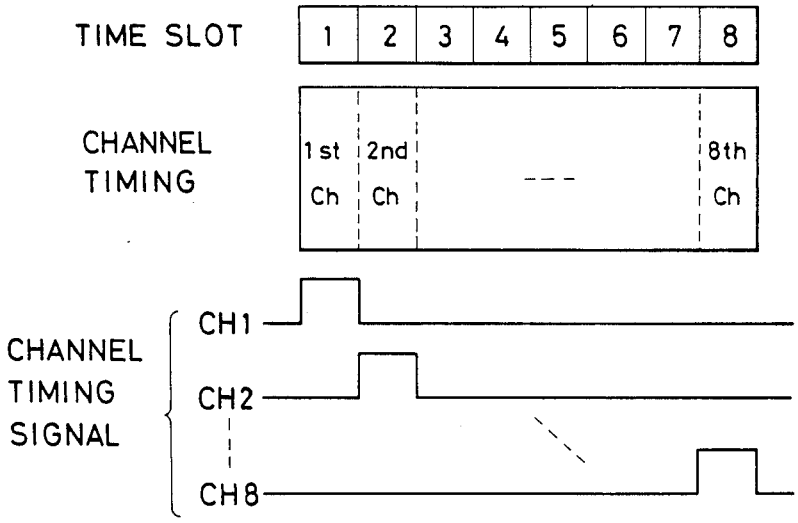
FIG. 4 is a timing chart illustrative of timing of signal processing effected in the electronic musical instrument shown in FIG. 3.
Figures 3, 3B:
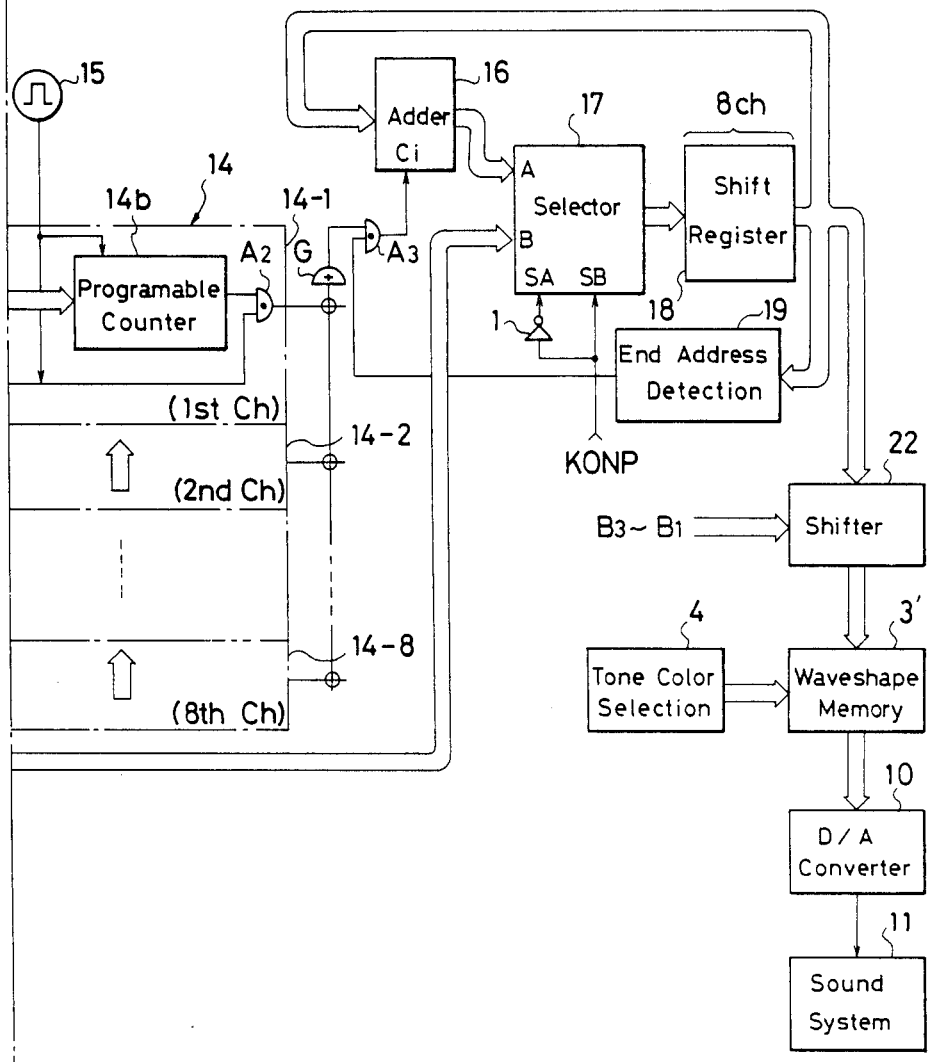

A frequency divider 14 comprises as many frequency divider circuits of identical construction as there are the musical tone production channels, that is, a frequency divider circuit 14-1 corresponding to the first channel, a frequency divider circuit 14-2 corresponding to the second channel, . . . , and a frequency divider circuit 14-8 corresponding to the eighth channel. As an example, the frequency divider circuit 14-1 has a latch circuit 14*a* for latching the frequency dividing ratio data on the first channel from the frequency dividing ratio memory 13 when a channel timing signal CH1 is applied in a time slot 1, and for delivering the latched frequency dividing ratio data to a programmable counter 14*b* in the frequency divider circuit 14. The programmable counter 14*b* frequency-divides a clock signal from a master clock generator 15 with the frequency dividing ratio data latched by the latch circuit 14*a*, that is, the frequency dividing ratio corresponding to the note of the key assigned to the first channel, and then feeds the frequency-divided pulses to an AND gate A2. Since the channel timing signal CH1 is also supplied to the AND gate A2, the latter allows the frequency-divided pulses to go to an OR gate G in the time slot 1 corresponding to the first channel. Likewise, the frequency divider circuit 14-2 latches the frequency dividing ratio data from the frequency dividing ratio memory 13 with a channel timing signal CH2, and supplies the OR gate G in a time slot 2 with pulses produced by frequency-dividing the clock signal with the latched frequency dividing ratio data. Similarly, the frequency divider circuit 14-8 operates in synchronism with a time slot 8 to supply the OR gate G with pulses produced by frequency-dividing the clock signal with a frequency dividing ratio corresponding to the note or pitch of the key assigned to the eighth channel. It is to be noted here that the programmable counter 14*b* in each of the frequency divider circuits 14-1 through 14-8 produces frequency-divided pulses having a total pulse duration equal to the interval of the time slots 1 through 8, as shown in FIG. 4. This is effective in enabling the AND gate A2 and the OR gate G to multiplex, on a time-sharing basis, the pulses frequency-divided by the frequency divider circuits 14-1 through 14-8.

The output from the frequency divider 14 is applied through the OR gate G and an AND gate A3 to a carry input terminal Ci of an adder 16. The AND gate A3 is enabled and disabled under the control of an output from an end address detector 19.

Figure 5:
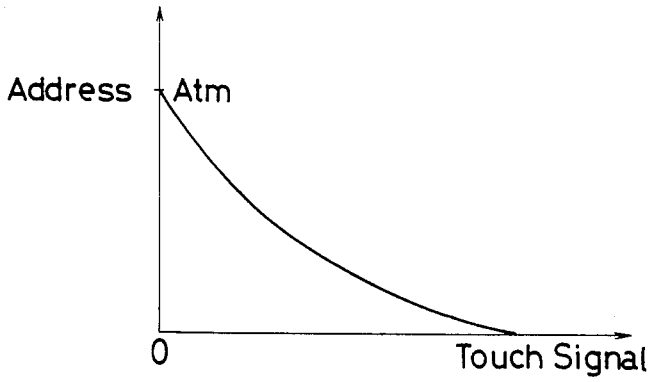
FIG. 5 is a graph showing the relationship between the output of a key depression touch and a readout start address in the electronic musical instrument of FIG. 3.

A touch signal representing the strength or magnitude of a key depression touch on the keyboard is converted by an A/D converter 20 into a corresponding digital signal, which is fed to a touch data converter 21. The touch data converter 21 issues a readout start address signal corresponding to the touch signal based on a touch data conversion table composed of touch signals and corresponding readout start addresses which are correlated as shown in FIG. 5. In the illustrated embodiment, the greater the touch output the smaller the readout start address signal as shown in FIG. 5.

A selector 17 has a terminal A supplied with an output from the adder 16 and a terminal B supplied with a readout start address signal from the touch data converter 21, and issues one of the data applied to the terminals A, B which is selected by selection signals applied to terminals SA, SB. More specifically, a key-on pulse signal KONP as inverted by an inverter I is applied to the terminal SA, and the key-on pulse signal KONP is fed directly to the terminal SB. When the key-on pulse signal KONP becomes "1" in the time slot of a certain channel, the readout start address signal applied to the terminal B is selected and issued as address data. When the key-on pulse signal KONP thereafter falls to "0", the output from the adder 16 applied to the terminal A is selected and issued as address data. Accordingly, when the depressed keys are assigned to the channels at key depression timing, the selector 17 produces the readout start address signal from the touch data converter 21 as the address data to the waveshape memory, and subsequently the selector 17 issues the added value from the adder 16 as the address data. A shift register 18 serves to store the output from the selector 17 temporarily for each channel, and then issues the output as address data on a time-sharing basis in synchronism with the time slots corresponding to the channels. The adder 16 adds the address data delivered on a time-sharing basis from the shift register 18 and the frequency-divided pulses applied from the frequency divider 14 on a time-sharing basis via the OR gate G and the AND gate A3, and issues the added data as new address data. When the frequency-divided pulses are "1", the adder 16 adds "1" and issues the sum. When the frequency-divided pulses are "0", the adder 16 adds nothing and issues them as they are. The end address detector 19 serves to detect when the address data issued in each channel from the shift register 18 reaches an end address $A_E$. The end address detector 19 generates a signal "0" when the end address $A_E$ is detected, and a signal "1" when the end address $A_E$ is not detected. When the end address detector 19 issues the signal "0" in the time slot of a certain channel, the AND gate A3 prevents the frequency-divided pulses in that channel from passing therethrough.

A shifter 22 serves to convert the address data from the shift register 18 into an address signal corresponding to an octave to which a depressed key belongs based on the octave codes $B_3$–$B_1$ contained in the key code KC in each channel. In the illustrated embodiment, the address data issued from the shift register 18 is processed as indicating the pitch of a highest octave by the frequency dividing ratio memory 13, as described above. Therefore, the shifter 22 shifts, based on the octave codes $B_3$–$B_1$ from the tone production assignment circuit 12, the address data by stages required to provide address data corresponding to the actual octave. The shifter 22 could be dispensed with if the frequency dividing ratio data corresponding to all key pitches were stored in the frequency dividing ratio memory 13. However, this would require the frequency dividing ratio memory 13 to have a large-capacity ROM, and render the memory 13 highly costly. In this embodiment, the frequency dividing ratio memory 13 is designed to store only those frequency dividing ratio data which correspond to the pitches ($C_6^{\#}$–$C_7$) of twelve notes of a highest octave, and the address data from the shift register 18 are shifted by the shifter 22 in accordance with an octave to which the depressed key belongs. With this arrangement, the frequency dividing ratio memory 13 is of a small capacity.

Figure 6:
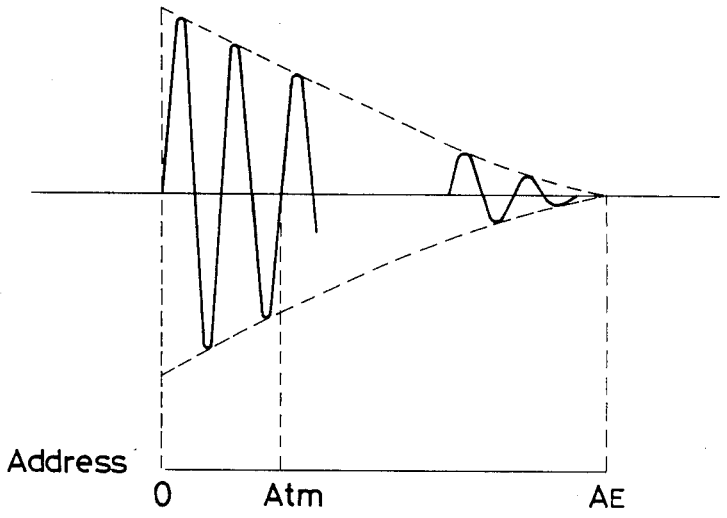
FIG. 6 is a diagram showing the waveform of a musical tone waveshape stored in a waveshape memory in the electronic musical instrument illustrated in FIG. 3.

A waveshape memory 3' stores therein musical tone waveshape data, as shown in FIG. 6, shared in common by all of the keys for each of the tone colors selectable by the tone color selection circuit 4. The stored musical tone data are varied slightly in waveshape, amplitude, and cyclic period from cycle to cycle, and read out on a time-sharing basis in each channel based on an address signal which varies at a rate corresponding to the pitch of the depressed key and which is fed from the shifter 22. A readout start address is determined by a readout start address signal from the touch data converter 21. One such readout start address is shown at Atm in FIG. 6. The musical tone waveshape data stored in the waveshape memory 3 have a maximum amplitude at the address "0", have its amplitude progressively smaller as the address is incremented, and have no amplitude at the address $A_E$ as shown in FIG. 6. This waveshape data arrangement is different from that shown in FIG. 2.

The musical tone waveshape data as read in each channel out of the waveshape memory 3' is converted by the D/A converter 10 into an analog signal, which is then reproduced as a musical tone by the sound system 11. As with the arrangement according to the first embodiment, since a musical tone waveshape read out dependent on the strength of a key depression touch varies in waveshape, amplitude and cyclic period from cycle to cycle, the tone color, level, and pitch of a generated musical tone is varied accordingly.

While in the foregoing embodiments the touch response function is gained by key depression touches, any other touch detector means may be employed which is provided independently of the keyboard solely for touch detection, such for example as a piezoelectric element disposed alongside of the keyboard. The touch detector means may be either provided for each key, shared by all of the keys, or provided for each of groups of keys. Where the touch detection circuit 5 shown in FIG. 3 is arranged to produce a touch signal for each key or each group of keys, the touch signals may be multiplexed on a time-sharing basis in channels by the technique as disclosed in U.S. Pat. No. 4,018,125 issued on Apr. 19, 1977 and entitled "Electronic Musical Instrument", and then applied to to the A/D converter 20. Instead of the key depression touch, other performance controllers than keys may be used for controlling the tone color, for example, of a musical tone. Examples are a knee lever operated by a player's knee, an expression pedal depressed by a foot, and a volume-control knob on a control panel of the electronic musical instrument.

While in the illustrated embodiments the digital memory is employed for storing the musical tone waveshape data, an analog memory can instead be used and the D/A converter may be dispensed with.

In the embodiment illustrated in FIG. 3, the pulse signals (frequency-divided pulses) of cyclic periods dependent on the pitch are repeatedly added to produce an address signal. However, there may be utilized a system for accumulating frequency numbers corresponding to pitches with a readout start address being set in the manner similar to the foregoing.

According to the first embodiment, the musical tone waveshape data is stored for each key on the keyboard, while one musical tone waveshape data is stored for all of the keys in the second embodiment. However, musical tone waveshape data having tone colors, pitch differences, level envelopes which vary slightly from octave to octave or from key group to key group may be stored in the waveshape memory, and may be selected and read out by corresponding octave codes of a key code. A plurality of musical tone waveshape data items for a single tone color may be stored in the waveshape memory, and may be simultaneously read out and added together.

In each of the foregoing embodiments, the waveshape memory stores musical tone waveshape data having a percussive envelope. An envelope control circuit composed of an envelope generator and a multiplier may be connected to the output of the waveshape memory for smoothing the envelope of a positive-going edge of the musical tone waveshape data as read out of the waveshape memory. The waveshape memory may store musical tone waveshape data having a steady envelope rather than a percussive envelope, and a start address from which to read out a positive-going edge or attack part of the data may be controlled by operation of the performance controller. In such an arrangement, the memory capacity may be reduced by repeatedly reading out a certain portion of the musical tone waveshape data stored in the waveshape memory as long as the steady portion of the musical tone waveshape with the steady envelope is concerned. The memory capacity may also be reduced with respect to the musical tone waveshape having a percussive envelope by repeatedly reading out a certain portion of the musical tone waveshape data while gradually reducing the amplitude thereof.

The foregoing embodiments are directed to electronic musical instruments in which musical tones can be produced which have pitches corresponding to depressed keys in a keyboard musical instrument. However, the present invention may be applied to rhythm instruments such that waveshape data of a cymbal, a bass drum, a snare drum, a tam-tam and the like are stored in a waveshape memory, and a start address from which to read out the waveshape data is changed in response to operation (touch output) of a performance controller, enabling natural rhythmic instrument sounds or percussive instrument sounds to be produced.

With the present invention, as described above, the tone color of a musical tone generated by an electronic musical instrument having a waveshape memory as a tone source, and also the level, decay time, and pitch variation of the musical tone can be varied as desired, in response to operation of a performance controller. Musical tones variable in a manner close to natural musical instruments can be produced by a simple circuit arrangement.

Although certain preferred embodiments have been shown and described, it should be understood that many changes and modifications may be made therein without departing from the scope of the appended claims.

What is claimed is:

1. An electronic musical instrument of waveshape memory type, comprising:

waveshape memory means for storing at respective memory addresses musical tone waveshape sampling data which represent at least one musical tone waveshape, the stored tone waveshape extending for plural consecutive cycles and varying in property as the waveshape extends to succeeding cycles;

keyboard circuit means for identifying a depressed key among a plurality of keys;

readout means responsive to said keyboard means for reading out from said waveshape memory means musical tone waveshape data representing that one musical tone waveshape which corresponds to said depressed key;

touch response control means operative for producing one of plural possible outputs for affecting performance expression of the instrument; and memory address specifying means, responsive to the output of said touch response control means, for specifying, in accordance with which one of said plural outputs is produced by said touch response control means, a start address of the waveshape memory means from which address said readout means starts to read out said data representing said corresponding one musical tone waveshape, thereby to control performance expression of a produced musical tone by reading out the same corresponding one musical tone waveshape, but beginning from a different starting address based on the output of said touch response control means.

2. An electronic musical instrument according to claim 1, in which the musical tone waveshape data stored in said waveshape memory means varies in waveshape as the waveshape extends to succeeding cycles.

3. An electronic musical instrument according to claim 1, in which the musical tone waveshape stored in said waveshape memory means varies in amplitude as the waveshape extends to succeeding cycles.

4. An electronic musical instrument according to claim 3, in which the amplitude of the musical tone waveshape stored in said waveshape memory means diminishes as the waveshape extends to succeeding cycles.

5. An electronic musical instrument according to claim 1, in which the musical tone waveshape stored in said waveshape memory means varies in cyclic period as the waveshape extends to succeeding cycles.

6. An electronic musical instrument according to claim 1, in which said touch response control means comprises means for detecting key depression speed or strength of the depressed key to obtain said output for actuating said memory address specifying means.

7. An electronic musical instrument according to claim 1, in which said waveshape memory means comprises a plurality of memory units each storing data of a musical tone waveshape corresponding to a specific key and a specific tone color.

8. An electronic musical instrument according to claim 1, in which said waveshape memory means comprises a memory unit storing data of a certain musical tone waveshape which unit is accessed in common with respect to said plurality of keys, and said readout means reads said memory unit at a rate corresponding to a pitch of the depressed key thereby providing a musical tone signal of a frequency corresponding to the depressed key.

9. An electronic musical instrument of waveshape memory type, comprising:

waveshape memory means for storing at respective memory addresses musical tone waveshape sampling data which represent at least one muscial tone waveshape, the stored tone waveshape extending for plural consecutive cycles and varying in property as the waveshape extends to succeeding cycles;

musical tone selection means for designating a musical tone waveshape to be read out of said waveshape memory;

readout means responsive to said tone selection means for reading out from said waveshape memory means musical tone waveshape data which corresponds to said designated musical tone waveshape;

expression control means operative for producing an output for affecting performance expression of the instrument; and memory address specifying means, responsive to the output of said expression control means, for specifying a start address of the waveshape memory means from which address said readout means starts to read out the waveshape data of said designated musical tone waveshape, thereby to control performance expression of a produced musical tone by selectively specifying the start address of readout of the same designated musical tone waveshape based on the output of said expression control means.

10. An electronic musical instrument of waveshape memory type comprising:

a waveshape memory storing single waveshape data which covers from start to end of a musical tone and which varies gradually in shape, amplitude and/or cyclic period as the waveshape extends through succeeding cycles;

expression control means for controlling a start address from which said single waveshape data begins to be read out, so that the tone characteristics of a produced tone are varied according to the expression control means.

* * * * *